US008523126B2

(12) United States Patent
Garrels et al.

(10) Patent No.: US 8,523,126 B2
(45) Date of Patent: Sep. 3, 2013

(54) WALL MOUNTABLE ACCESSORY ASSEMBLY

(75) Inventors: Clayton C. Garrels, Sheboygan, WI (US); Thomas M. Spankowski, Port Washington, WI (US)

(73) Assignee: Kohler Co., Kohler, WI (US)

( * ) Notice: Subject to any disclaimer, the term of this patent is extended or adjusted under 35 U.S.C. 154(b) by 316 days.

(21) Appl. No.: 12/759,802

(22) Filed: Apr. 14, 2010

(65) Prior Publication Data

US 2011/0253854 A1 Oct. 20, 2011

(51) Int. Cl.
*A47B 96/00* (2006.01)

(52) U.S. Cl.
USPC ..... 248/222.14; 248/251; 248/222.11; 248/201; 29/525.01; 211/105.1

(58) Field of Classification Search
USPC ..... 248/222.14, 220.21, 223.31, 223.41, 248/224.61, 225.11, 251, 239.1, 201; 4/576.1, 4/559; 174/153 A, 164, 168; 211/105.1; 29/525.01
See application file for complete search history.

(56) References Cited

U.S. PATENT DOCUMENTS

| | | | | |
|---|---|---|---|---|
| D28,863 | S | 6/1898 | Baker | |
| 3,164,354 | A * | 1/1965 | Murdock | 248/251 |
| 3,282,548 | A | 11/1966 | Ruhnke | |
| 4,895,332 | A | 1/1990 | Hansen et al. | |
| 5,050,252 | A | 9/1991 | Cuttriss | |
| 5,200,240 | A | 4/1993 | Baker | |
| 5,529,288 | A | 6/1996 | Cheng-I | |
| 5,860,538 | A * | 1/1999 | Duero et al. | 211/123 |
| 6,112,344 | A * | 9/2000 | Guenther | 4/576.1 |
| 6,131,213 | A | 10/2000 | Sariff | |
| 6,430,759 | B1 * | 8/2002 | Beltran | 4/576.1 |
| 6,796,442 | B1 * | 9/2004 | Wu | 211/105.1 |
| 6,932,328 | B2 | 8/2005 | Shreiner et al. | |
| 7,124,451 | B2 * | 10/2006 | Moore | 4/576.1 |
| 7,490,803 | B1 * | 2/2009 | Graves | 248/251 |
| 7,597,297 | B2 | 10/2009 | Isfeld et al. | |
| 7,766,291 | B2 * | 8/2010 | Eilmus et al. | 248/222.11 |
| 7,874,025 | B2 * | 1/2011 | Bowden et al. | 4/576.1 |
| 7,934,274 | B2 * | 5/2011 | Forrest et al. | 4/576.1 |
| 7,967,522 | B2 * | 6/2011 | Goad | 403/292 |
| 8,070,137 | B2 * | 12/2011 | Bennett | 256/65.16 |
| 2009/0211014 | A1 * | 8/2009 | Forrest et al. | 4/576.1 |

* cited by examiner

*Primary Examiner* — Terrell McKinnon
*Assistant Examiner* — Monica Millner
(74) *Attorney, Agent, or Firm* — Foley & Lardner LLP

(57) ABSTRACT

Wall mountable accessory assemblies suitable to be mounted in a bathroom are disclosed. As an example, there is a grab bar assembly that has at least one mounting bracket, a grab bar, and a set screw. The bracket includes a rearward portion mountable to the wall and a frontal portion having a first recess which is forwardly open. The bracket also has a side catch groove structure. A projection on the grab bar is laterally slid into the catch groove structure and interfit therewith. The screw is inserted in the first recess so as to thereby drive a portion of the grab bar forward, inhibiting relative movement between the grab bar and the bracket.

20 Claims, 8 Drawing Sheets

WALL MOUNTABLE ACCESSORY ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to assemblies for mounting wall mountable accessories such as grab bars, soap dishes and the like on supporting walls. It appears especially well-suited for grab bars mounted on bathing enclosure walls.

Grab bars and other bathroom accessories may be mounted at various locations in bathrooms. For example, in a shower stall having a seat, it may be desirable to place a grab bar near the seat so that a user has a fixed support to assist in sitting down or standing up. Similarly, grab bars are often positioned adjacent toilets to facilitate the elderly, the disabled, and others sitting down and standing up from the toilet.

However, many known grab bars are relatively heavy metal structures. These heavy metal structures may require complex mounting assemblies to keep them secured to the wall. Both the amount of material needed for the grab bar and a complex mounting system can add cost to the overall assembly. Further, given the complexity of mounting into the wall, once installed many of these grab bars are essentially permanent located, making temporary removal for cleaning or replacement of the bar for ornamental reasons difficult to do.

Moreover, grab bars must be precisely mounted on the wall and there is little room for error in the placement of mounting components. This has made installation of such fixtures troublesome, particularly in tight spaces.

Similar issues arise when mounting towel bars, soap dishes, and other bathroom accessories along bathroom vertical walls.

Hence, there still is a need to develop improved wall mountable accessory assemblies.

SUMMARY OF THE INVENTION

According to one aspect of the invention, there is provided a wall mountable accessory assembly. It has at least one bracket having a rearward portion mountable to the wall and a frontal portion having a first recess which is forwardly open, the bracket also having a side catch groove structure. The wall mountable accessory also has a projection which has been laterally slid into the catch groove structure and interfit therewith. There is also a screw inserted in the first recess so as to thereby drive a portion of the wall mountable accessory forward and thereby inhibit relative movement between the wall mountable accessory and the bracket.

In preferred forms, the wall mountable accessory assembly may be a grab bar assembly. That assembly can have a grab bar with a second recess which is rearwardly open such that the screw is inserted in both recesses simultaneously. At least one or both of the recesses may be threaded.

Most preferably for grab bars, towel bars and the like there are at least two such brackets and at least two such screws mounting the wall mountable accessory relative to the wall. For smaller accessories like soap dishes or cup holders, a single bracket may suffice.

In other preferred aspects, the catch groove structure is in a form of an annular groove and the projection is in a form of a pair of opposed facing rails running longitudinally along the wall mountable accessory. Also, the wall mountable accessory can have an extruded metallic rail having an essentially hollow, essentially C-shaped, configuration, and the accessory can be longitudinally curved.

In another aspect, the invention provides a method of installing a grab bar to a support wall. One obtains a grab bar assembly of the above type. One then slides the rails into the side catch groove structure, and fixes the rails relative to the catch groove structure by inserting the set screw in the recess, thereby driving a portion of the grab bar forward. In one preferred form, the bracket and the grab bar can be slid together before the bracket is mounted to the wall. In another preferred form, the bracket can be attached to the wall before the rails of the grab bar are slid into the catch groove structure of the bracket.

Hence, the present invention can be understood to provide improved assemblies for mounting grab bars and other bathroom accessories. The accessories can be linked to their supporting bracket(s) by relative lateral sliding therebetween, and locked in place with a set screw.

However, by loosening the set screw the accessory can be removed from the bracket by reversing the lateral movement, or in compact situations (and with sufficient force) by forward movement away from the bracket.

This facilitates rough linking of the brackets and the grab bar (or the like) with respect to one another before the brackets are attached to the wall. This permits some lateral play between the components during positioning on the wall. Moreover, the accessory can be removed to facilitate cleaning or decorative replacement, without adversely affecting the support linkage of the brackets to a wall.

Also, the grab bars or the like can be made of extruded lightweight aluminum, yet still be sufficiently strong to support someone leaning against them. The bars can be fixed in place with the connection hidden from normal view thereafter.

These and still other advantages of the invention will be apparent from the detailed description and drawings. What follows is merely a description of preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENT

Figure 1:
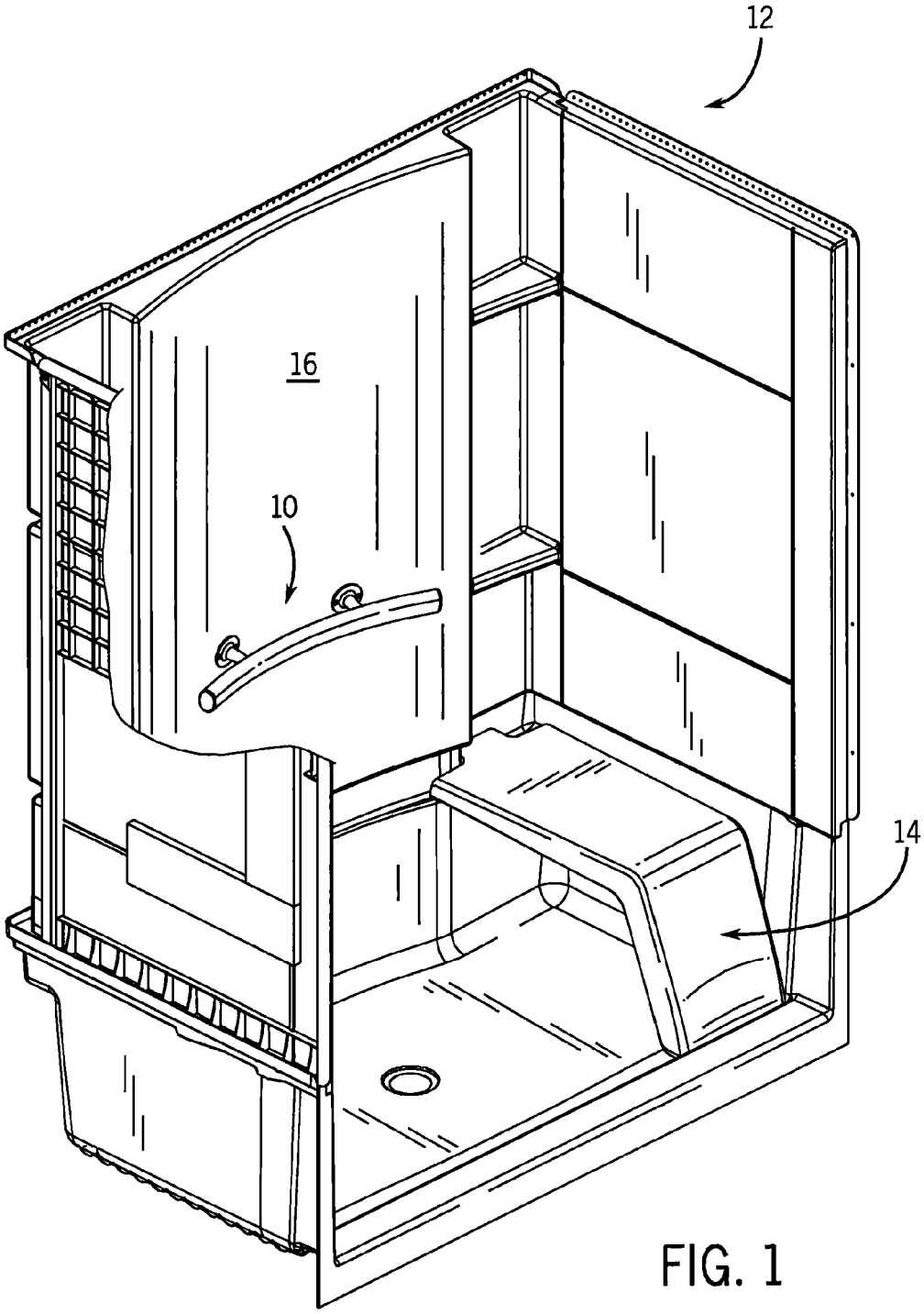
FIG. 1 is a left, frontal, upper perspective view of a shower stall having a grab bar assembly according to the present invention mounted on a rear wall of the shower stall.
Figure 2:
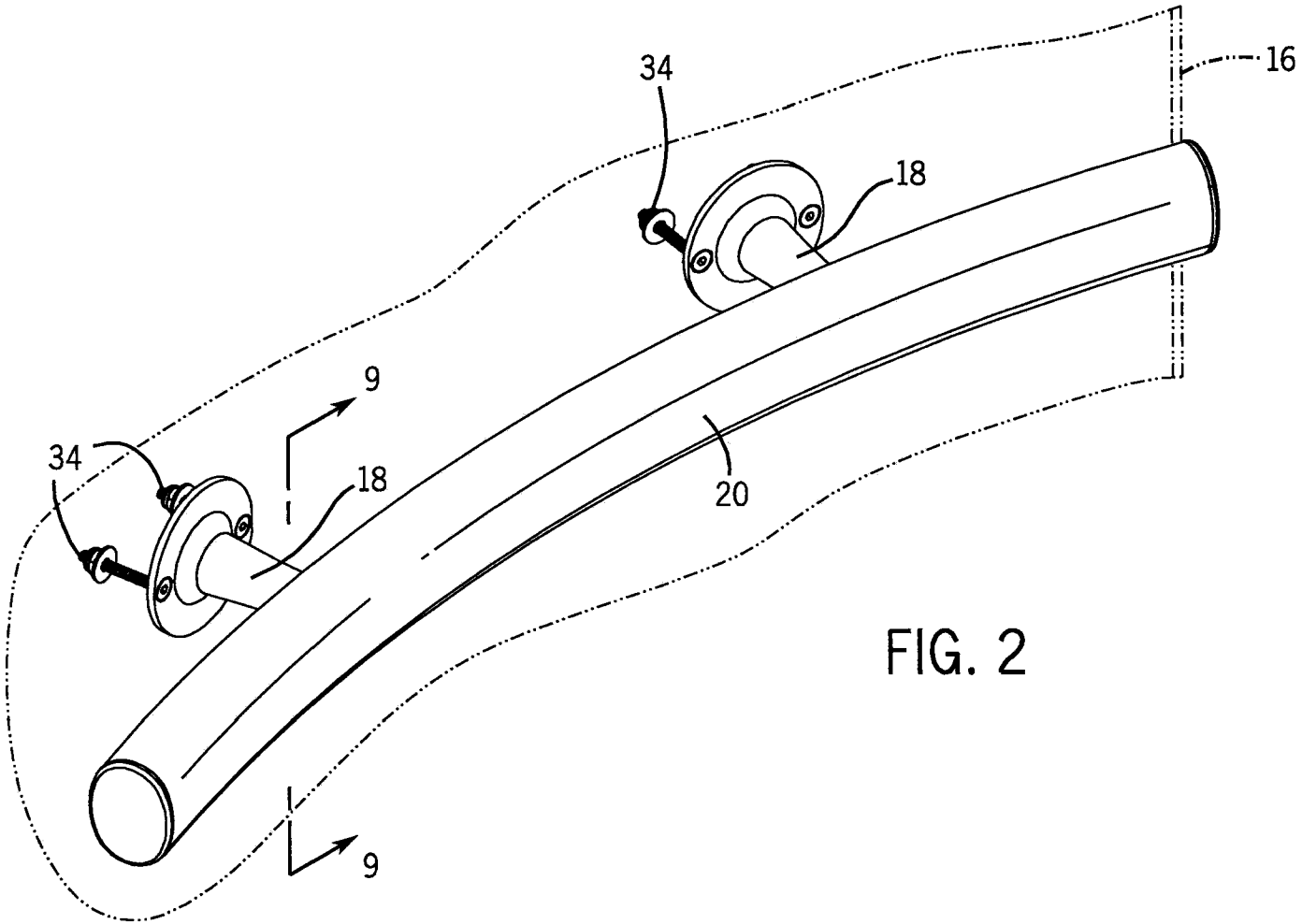
FIG. 2 is an enlarged left, frontal, upper perspective view of a preferred grab bar of the present invention mounted on the FIG. 1 shower stall.

Referring first to FIG. 1, a grab bar assembly 10 according to the present invention is shown installed in a shower stall 12. The specifics of the stall are not critical. As one example, there can be a shower stall 12 that has a removable seat 14 placed on one side thereof and the grab bar assembly 10 can be mounted nearby on a rear wall 16 of the shower stall 12.

The grab bar assembly 10 can be positioned such that the grab bar assembly 10 serves as support assistance for those sitting down or standing up from the removable seat 14. Even if the removable seat 14 is removed from the shower stall 12, the grab bar assembly 10 will be located such that it may provide support assistance to an individual standing upright in the shower stall 12 or entering or exiting the shower stall 12.

In the shower stall 12 shown, the rear wall 16 of the shower stall 12 is a slightly curved surface and the grab bar assembly 10 is also longitudinally curved to match the rear wall 16. It should be appreciated, however, that the grab bar assembly 10 could be mounted to any wall inside or outside of a shower stall. Further, if the wall to which the grab bar assembly is mounted is planar, then the grab bar assembly may be configured to be straight.

Turning next to FIGS. 2 through 9, the grab bar assembly 10 includes a pair of brackets 18, a grab bar 20, and a set screw 22 for each of the brackets 18 which is inserted between the grab bar 20 and the corresponding bracket 18.

Each of the brackets 18 has a rearward portion 24 and a frontal portion 26. The rearward portion 24 is mountable to a wall such as the rear wall 16. In the particular embodiment shown, the bracket 18 can include a disc-shaped flange 28 with two mounting holes 30 on either side of a forwardly-extending neck 32. The two mounting holes 30 receive fasteners 34 such as nuts and bolts, screws, or the like which can be used to mount the bracket 18 to the rear wall 16.

When mounted, the neck 32 extends forward from the disc-shaped flange 28 to a head 36 proximate the frontal portion 26 of the bracket 18. The head 36 is connected to the grab bar 20. The head 36 includes a forwardly-opening recess 38 formed on a forwardly-facing surface 40 of the head 36. This forwardly-opening recess 38 receives one of the set screws 22 from a generally lateral direction during installation.

Figure 6:
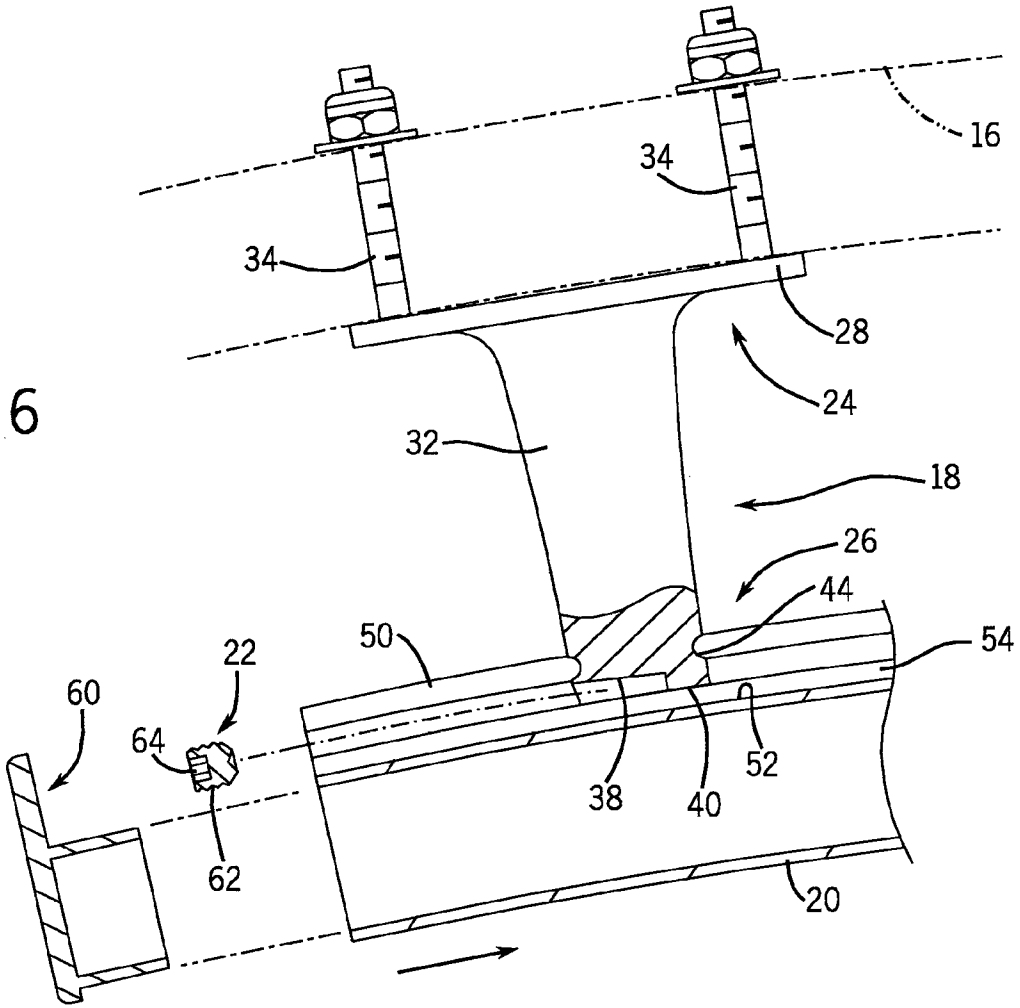
FIG. 6 is a partial horizontal cross sectional view, partially fragmented and exploded, showing in enlarged fashion the grab rail in the process of being mounted to a bracket.
Figure 8:
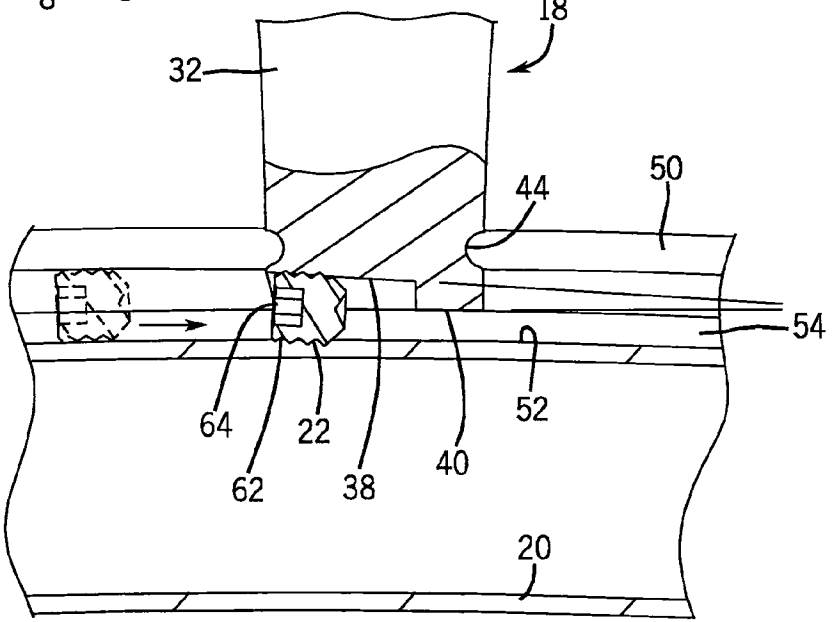
FIG. 8 is a detailed view taken along line 8-8 of FIG. 7.

As best shown in FIGS. 6 and 8, this forwardly-opening recess 38 has the shape of a half-pipe and tapers as it extends inwardly from a periphery 42 of the head 36. The head 36 further includes a catch groove structure which, in the form shown, is an annular groove 44. The annular groove 44 is in a plane essentially perpendicular to the direction of neck extension and is slightly rearwardly offset from the forwardly-facing surface 40 in which the forwardly-opening recess 38 is formed.

Figure 3:
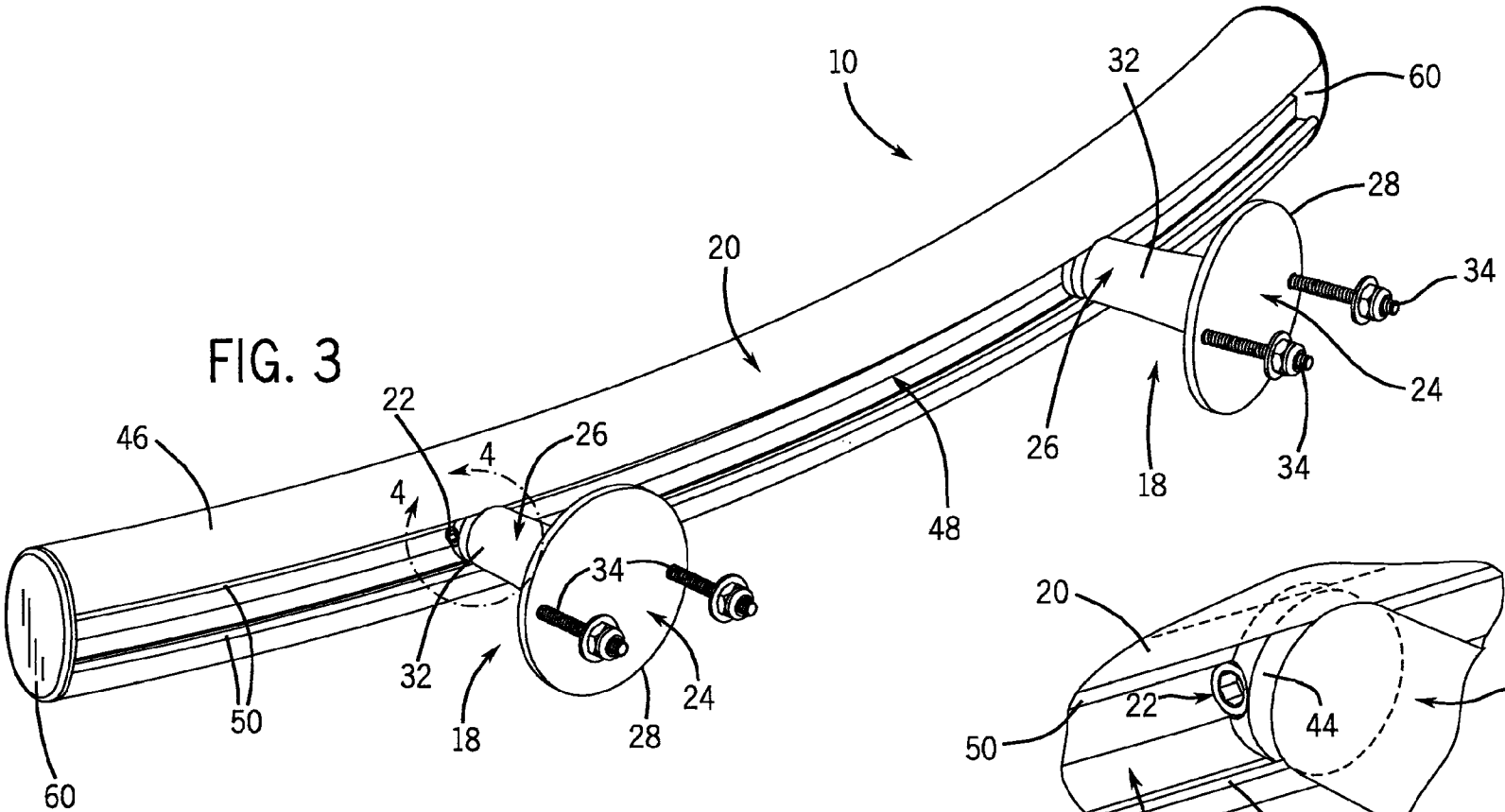
FIG. 3 is a rear perspective view of the FIG. 2 grab bar.
Figure 4:
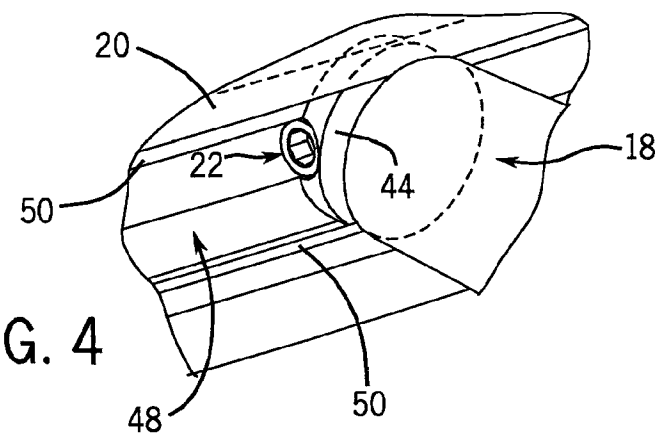
FIG. 4 is a detailed view according to line 4-4 of FIG. 3.
Figure 5:
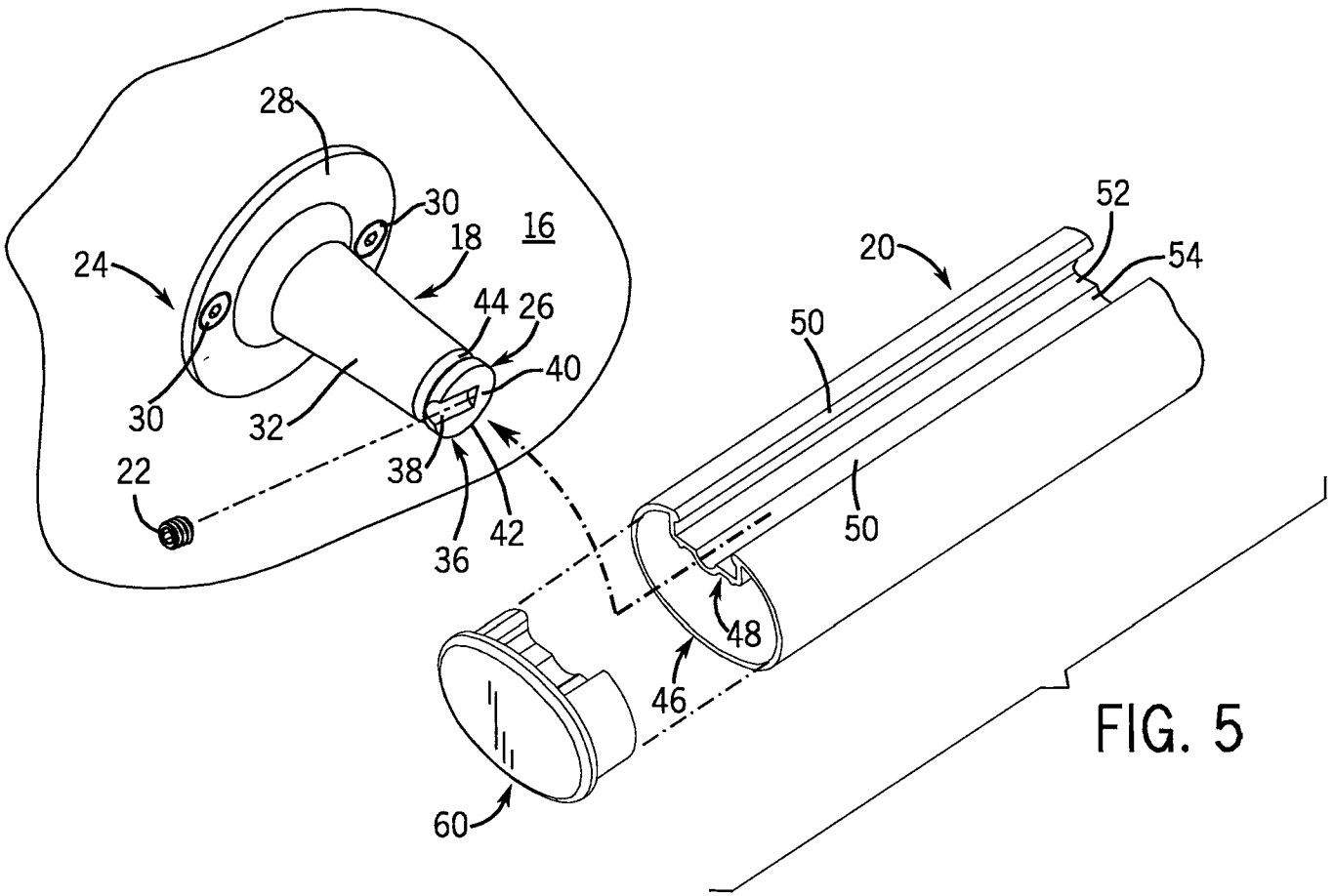
FIG. 5 is a partially exploded and rotated, partially fragmented, perspective view of one end of the FIG. 2 grab bar assembly shown mounted on a wall.
Figure 7:
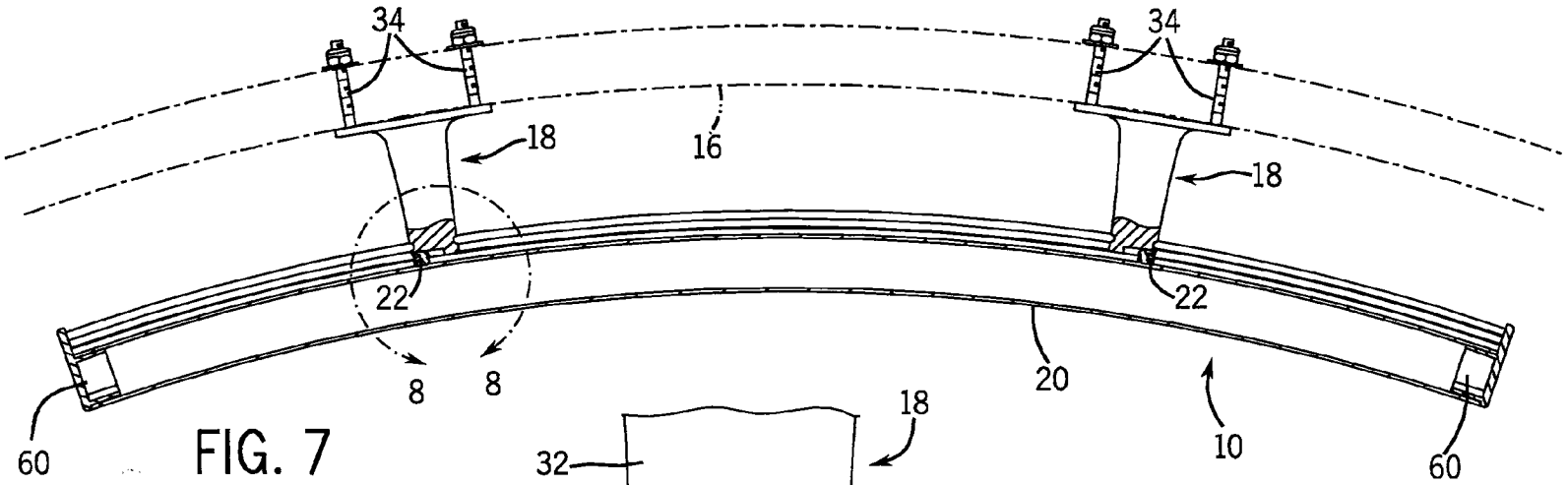
FIG. 7 is a view similar to FIG. 6, with the parts more fully assembled, and showing more of the structure.
Figure 9:
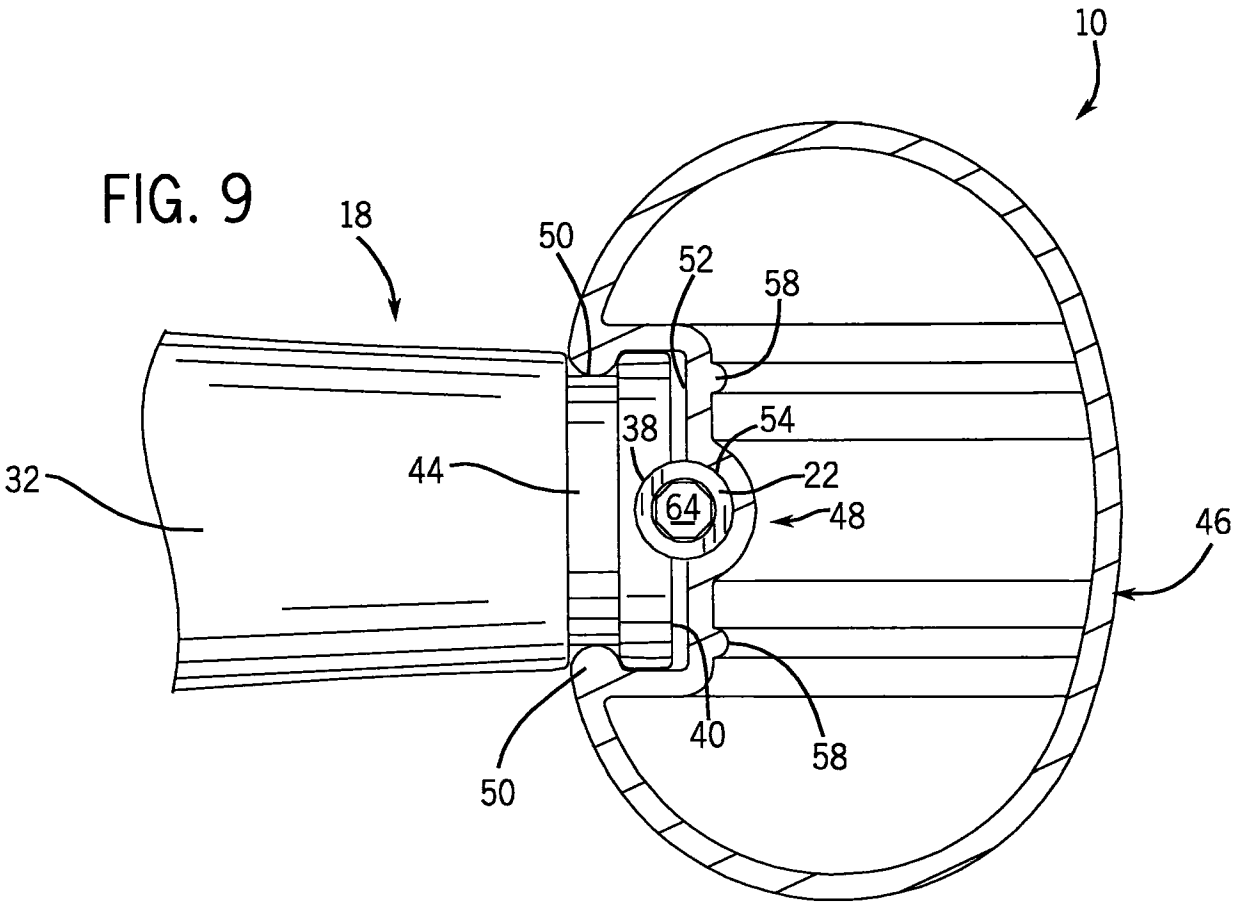
FIG. 9 is a sectional view taken along line 9-9 of FIG. 2.

As best seen in FIGS. 5 and 9, the grab bar 20 is a curved extrusion, preferably comprising aluminum, having an essentially hollow C-shaped cross section. The cross section of the grab bar 20 includes a generally elliptical or oval shaped portion 46 with a rearward mating portion 48 formed in the convex side of the grab bar 20. The rearward mating portion 48 is recessed into the grab bar 20 and is shaped so as to receive the heads 36 of the brackets 18. The rearward mating portion 48 runs the length of the grab bar 20 as best illustrated in FIGS. 3 and 7, and is typically hidden from the plain view of the user when the grab bar assembly 10 is mounted in the shower stall 12.

The rearward mating portion 48 includes a pair of opposed inwardly facing rails 50 or projections. The pair of opposed inwardly facing rails 50 are formed on the outer side of the extrusion of the grab bar 20 and run longitudinally along the grab bar 20. This pair of opposed inwardly facing rails 50 are spaced so as to interfit in the annular groove 44 of the head 36 of the bracket 18.

As best seen in FIG. 5, between the pair of opposed inwardly facing rails 50, the rearward mating portion 48 also includes a rearwardly-facing surface 52 with a rearwardly-opening recess 54 formed longitudinally therein. This rearwardly-opening recess 54 has, as the forwardly-opening recess 38 of the bracket 18, a half pipe shape, albeit an axially bowed half pipe shape. When aligned with the forwardly-opening recess 38, the rearwardly-opening recess 54 forms the second half of the hole for receiving the set screw 22.

The inside of the extrusion of the grab bar 20 also includes two longitudinally extending ridges 58 which may be used to help wedge and thereby retain an end cap 60 in position at the hollow ends of the grab bar 20. When attached, the end cap 60 helps to obscure the view of the set screw 22 as well as the rearward mating portion 48 from the side.

The set screw 22 includes a threaded body 62 and a head 64 which may receive a screw driver or the like for tightening or loosening the set screw 22. The set screw 22 is inserted between the forwardly-opening recess 38 and the rearwardly-opening recess 54. As the forwardly-opening recess 38 is tapered, as the set screw 22 is inserted, the set screw 22 moves the grab bar 20 forward relative to the bracket 18. By driving the grab bar 20 forward, the projections or pair of opposed inwardly facing rails 50 of the grab bar 20 are pushed into the side wall of catch groove structure (e.g., the annular groove 44).

As the projections of the grab bar 20 and the catch groove structure of the bracket 18 are pushed against one another, this effectively locks the bracket 18 relative to the grab bar 20. The increased force between the two components increases lateral resistance to movement by increasing normal force, which in turn increases the frictional force which would need to be overcome in order to slide the grab bar 20 laterally.

It is contemplated that in some forms, during the insertion of the set screw 22, the pair of opposed inwardly facing rails 50 of the grab bar 20 may deflect inward as the set screw 22 drives the rearwardly-opening recess 54 toward the center of the extrusion. This deflection may result in an additional retaining or clamping force being applied by the pair of opposed inwardly facing rails 50 to the annular groove 44 of the bracket 18.

While the set screw 22 has a threaded body 62, it is contemplated that neither, one, or both of the forwardly-opening recess 38 and the rearwardly-opening recess 54 may have mating threads. Depending on the particular materials selected for the bracket 18 and the grab bar 20, the body 62 of the set screw 22 may dig into or deform one or more of the surfaces in a manner sufficient to wedge the set screw 22 between the bracket 18 and the grab bar 20, thereby providing sufficient frictional force for mounting. If both of the bracket 18 and the grab bar 20 are sufficiently rigid that the set screw 22 would not deform either of the recesses 38 and 54, then at least one of the recesses 38 and 54 would need to have a set of threads formed therein to receive the set screw 22.

The grab bar assembly 10 may be installed according to the method now described. As shown best in FIG. 5, the heads 36 of one or more brackets 18 are laterally interfit with the rearward mating portion 48 of the grab bar 20. In this regard, the pair of opposed inwardly facing rails 50 on the grab bar 20 are laterally slid into the annular groove 44 of bracket 18.

Before the set screw 22 is tightened in place, the brackets 18 are still laterally slideably moveable within the rearward mating portion 48 of the grab bar 20. Once the brackets 18 have been moved to the desired position along the grab bar 20 and the forwardly-facing recess 38 has been rotationally aligned with the rearwardly-facing recess 54, then the set screw 22 is tightened between the bracket 18 and the grab bar 20 at the recesses 38 and 54. As the set screw 22 is tightened, the set screw 22 pushes or wedges the grab bar 20 away from the bracket 18 as is best seen in FIGS. 8 and 9.

As the set screw 22 is tightened, the force with which the pair of opposed inwardly facing rails 50 is pressed against the walls of the annular groove 44 is increased, thereby increasing the frictional resistance to lateral sliding of the brackets 18 along the grab bar 20. This essentially locks the grab bar 20 to the brackets 18. Of course, the set screw 22 might be loosened thereafter to allow removal of the grab bar 20 to facilitate cleaning behind the grab bar 20, or to permit replacement with a differently decorated bar.

As the rearward mating portion 48 extends the length of the grab bar 20, this provides space to insert a screwdriver or the like to tighten the set screw 22. Once the set screw 22 is in place, the end cap 60 may be inserted into the extruded open end of the grab bar 20, thereby capping the opening and concealing the channel that serves as the rearward mating portion 48.

Advantageously, this construction allows for rough placement of the components relative to one another prior to affixing the brackets to the wall. This permits installation in relatively tight positions.

It should further be appreciated that while two brackets 18 are shown as being used to mount a grab bar 20, that more or less brackets may be used to mount a selected wall mountable accessory to a wall. For example, in some cases it may be desirable, either for aesthetics or for structural support, to have three or more brackets. Likewise, a single bracket may be sufficient to mount some types of accessories to a wall.

Figure 10:
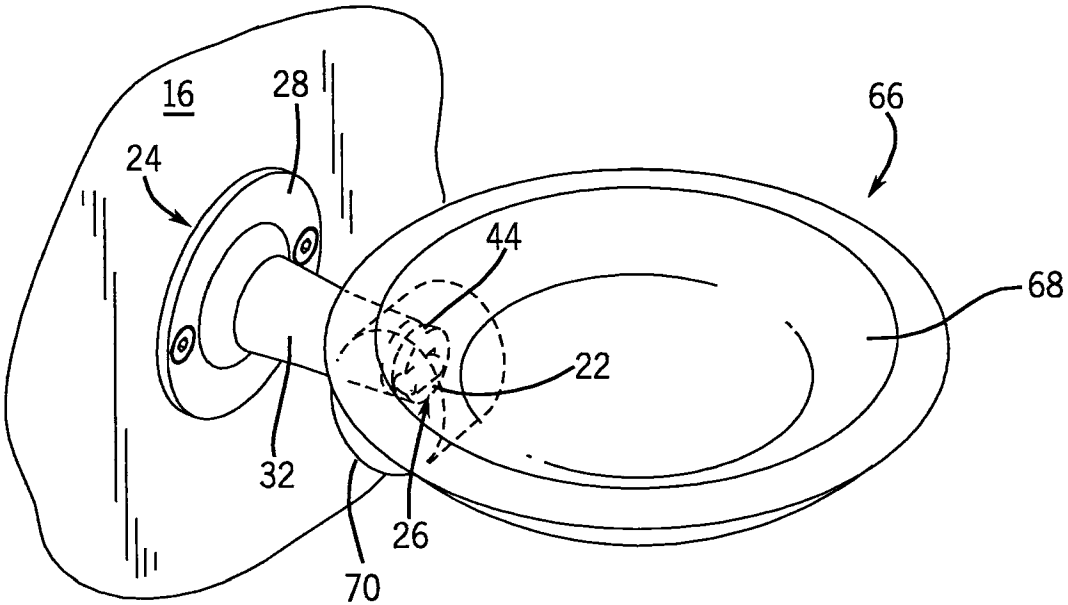
FIG. 10 is a view similar to FIG. 2, but showing a second embodiment where a soap dish is supported by a single bracket.

As one example, FIG. 10 depicts a soap dish accessory 66 mounted to a wall 16 using an analogous construction, albeit using only one bracket 18. The soap dish accessory 66 has a basin part 68 with a rear mounting portion 70 attached thereto. This mounting portion 70 has a structure much like the portion of the grip rail depicted in FIG. 6, apart from the linkage to the dish.

Thus, there is a projection that is slid into a catch groove structure of the bracket, and again, a set screw 22 that is inserted between two recesses of the bracket 18 and the mounting portion 70 to wedge them apart, thereby mounting them with respect to one another. Instead of a soap dish, a wide variety of other bathroom accessories could be mounted in this fashion (e.g. tumbler holder, robe hook, towel ring, etc.).

In sum, the present invention provides a wall mountable accessory assembly having a variety of highly desirable features. The bracket and accessory are easily and quickly connected to one another. The assembly provides for simple, intuitive installation even in tight or confined areas.

While specific embodiments of the invention have been disclosed, it should be appreciated that various other modifications and variations to the preferred embodiments can be made within the spirit and scope of the invention. Thus, the invention should not be limited to just the described embodiments. To ascertain the full scope of the invention, the following claims should be referenced.

Industrial Applicability

The invention provides improved wall mountable accessory assemblies and methods of mounting them to bathroom or other walls.

What is claimed is:

1. A wall mountable accessory assembly, comprising:

at least one bracket having a rearward portion mountable to the wall and configured to face the wall when mounted thereto, and a frontal portion having a first recess configured to face away from the wall in a forward direction generally perpendicular to the wall when the bracket is mounted thereto, the bracket also having a side catch groove structure;

a wall mountable accessory having a projection which has been laterally slid relative to the forward direction into the side catch groove structure and interfit therewith; and a screw inserted in the first recess so as to thereby drive a portion of the wall mountable accessory in the forward direction and thereby inhibit relative movement between the wall mountable accessory and the bracket, the screw being compressed in a radial direction between the bracket and the wall mountable accessory.

2. The wall mountable accessory assembly of claim 1, wherein the wall mountable accessory assembly is a grab bar assembly mountable along an essentially vertical wall.

3. The assembly of claim 1, wherein the wall mountable accessory comprises a second recess which is open in a rearward direction toward the first recess, such that the screw is simultaneously received by the first and second recesses.

4. The assembly of claim 3, wherein at least one recess is configured to threadedly receive the screw.

5. The assembly of claim 3, wherein both the first and second recess are configured to threadedly receive the screw.

6. The assembly of claim 1, wherein there are at least two such brackets and at least two such screws mounting the wall mountable accessory relative to the wall.

7. The assembly of claim 1, wherein the catch groove structure is in a form of an annular groove and the projection is in a form of a pair of opposed facing rails running longitudinally along the wall mountable accessory.

8. The assembly of claim 1, wherein the wall mountable accessory comprises an extruded metallic rail having an essentially hollow, essentially C-shaped, configuration.

9. The assembly of claim 1, wherein the wall mountable assembly is longitudinally curved.

10. A method of installing a grab bar to a wall comprising:

obtaining a grab bar assembly comprising:

at least one bracket having a rearward portion mountable to the wall, a frontal portion of the bracket having a first recess configured to face away from the wall in a forward direction generally perpendicular to the wall when the bracket is mounted thereto, the bracket also having a side catch groove structure;

a grab bar having opposed facing rails which can laterally slide into the side catch groove structure and interfit therewith; and a set screw insertable in the first recess;

sliding the rails into the side catch groove structure; and fixing the rails relative to the catch groove structure by inserting the set screw in the recess and thereby driving a portion of the grab bar in the forward direction, such that the screw is compressed in a radial direction between the bracket and the grab bar.

11. The method of claim 10, wherein the bracket and the grab bar are slid together before the bracket is mounted to the wall.

12. The method of claim 10, wherein the bracket is attached to the wall before the rails of the grab bar are slid into the catch groove structure of the bracket.

13. A wall mountable assembly, comprising:

at least one bracket having a rearward portion mountable to the wall, a neck, and a head configured to face away from the wall in a forward direction generally perpendicular to the wall when the bracket is mounted thereto, the neck extending forward from the rearward portion to the head and having an annular groove proximate the head and generally perpendicular to the forward direction; and an accessory having a recessed portion with at least one projection;

wherein the recessed portion of the accessory is configured to slideably receive the head of the bracket therein in a direction generally perpendicular to the forward direction, and the annular groove of the bracket is configured to slideably receive the projection of the accessory in a direction generally perpendicular to the forward direction; and wherein the at least one bracket and the accessory are configured to receive a set screw therebetween, such that the set screw is compressed in a radial direction and inhibits relative movement between the bracket and the accessory.

14. The wall mountable assembly of claim 13, wherein:

the head of the bracket includes a forwardly-facing surface configured to face away from the wall, and the recessed portion of the accessory includes a rearwardly-facing surface configured to face toward the wall when coupled to the head of the bracket; and forcing apart the forwardly-facing surface of the bracket and the rearwardly-facing surface of the accessory acts to force together the annular groove of the bracket and the projection of the accessory.

15. The wall mountable assembly of claim 14, wherein the forwardly-facing surface of the bracket and the rearwardly-facing surface of the accessory are configured to receive therebetween and be forced apart by the set screw.

16. The wall mountable assembly of claim 15, wherein the bracket includes a first recess in the forwardly-facing surface and the accessory includes a second recess in the rearwardly-facing surface, wherein the first and second recess are configured to receive the set screw to force the forwardly-facing surface apart from the rearwardly-facing surface.

17. The wall mountable assembly of claim 16, wherein at least one of the first recess or the second recess includes threads for receiving the set screw.

18. The wall mountable assembly of claim 13, wherein the accessory includes two projections that are in generally opposed relation to each other, wherein the two projections are configured to be received in generally opposite sides of the annular groove of the bracket.

19. The wall mountable assembly of claim 13, wherein:

the accessory is elongated, extending from a first end to a second end;

the recessed portion of the accessory is a channel extending from the first end to the second end; and the channel is configured to receive the head of the bracket in a generally axial direction relative to the accessory.

20. The wall mountable assembly of claim 19, wherein the bracket is configured to slide axially relative to the accessory from the first end or the second end to a position at which the accessory may be locked relative to the bracket.

* * * * *